US010533823B1

(12) United States Patent
Smith

(10) Patent No.: US 10,533,823 B1
(45) Date of Patent: Jan. 14, 2020

(54) TENSION GUN FOR FIRING ARROWS

(71) Applicant: Lewis Smith, Cherokee Village, AR (US)

(72) Inventor: Lewis Smith, Cherokee Village, AR (US)

( * ) Notice: Subject to any disclaimer, the term of this patent is extended or adjusted under 35 U.S.C. 154(b) by 0 days.

(21) Appl. No.: 16/172,792

(22) Filed: Oct. 27, 2018

(51) Int. Cl.
*F41B 7/04* (2006.01)
*F41B 7/00* (2006.01)

(52) U.S. Cl.
CPC ..... *F41B 7/003* (2013.01); *F41B 7/04* (2013.01); *F41B 7/046* (2013.01)

(58) Field of Classification Search
CPC .. F41B 3/005; F41B 7/00; F41B 7/003; F41B 7/04; F41B 7/046
See application file for complete search history.

(56) References Cited

U.S. PATENT DOCUMENTS 3,509,863 A * 5/1970 Barker ..... F41B 7/003 124/16
3,517,657 A 6/1970 Alban
4,123,975 A 11/1978 Mohaupt
4,860,719 A * 8/1989 Scheiterlein ..... F41B 5/143 124/25
5,671,722 A 9/1997 Moody
6,273,078 B1 * 8/2001 Schwesinger ..... F41B 5/12 124/16
8,576,376 B2 * 11/2013 Mann ..... G02B 17/0652 355/51
9,052,154 B1 * 6/2015 Prior ..... F41B 5/123
9,719,749 B1 * 8/2017 Prior ..... F41B 5/0094
2004/0065310 A1 4/2004 Masse
2011/0041820 A1 2/2011 Stanziale
2015/0354916 A1 * 12/2015 Polanich ..... F41B 7/00 124/25.6

* cited by examiner

*Primary Examiner* — John A Ricci

(57) ABSTRACT

The invention is directed to a tension gun for firing arrows. The tension gun is comprised of a stock, a trigger, a pistol grip, and a forearm which are configured in a manner which is similar to a conventional crossbow. The bow arms are removed from the design, and replaced by a pair of coaxial coil springs and other tension multipliers within the forearm, which propel the arrow. A folding handle at the forward end of the forearm is provided for carrying the tension gun.

10 Claims, 5 Drawing Sheets

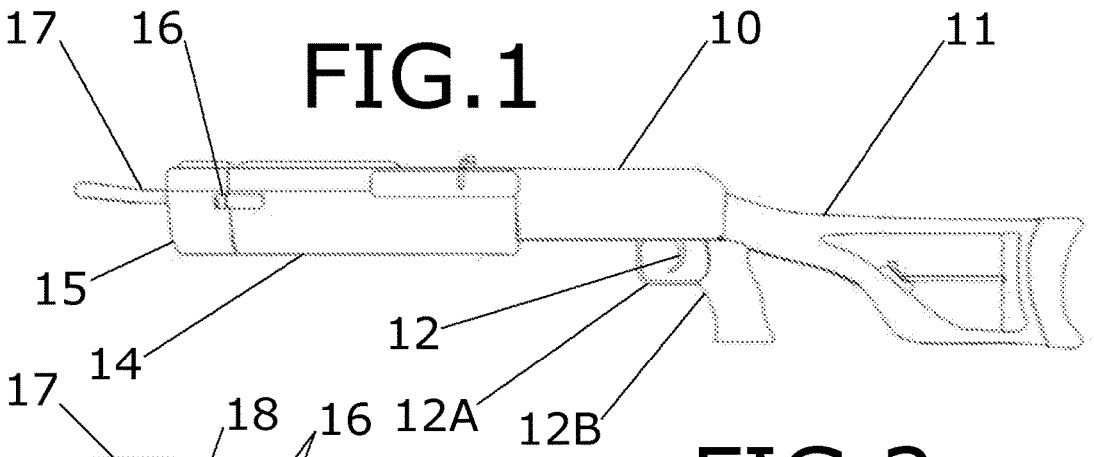
FIG.1
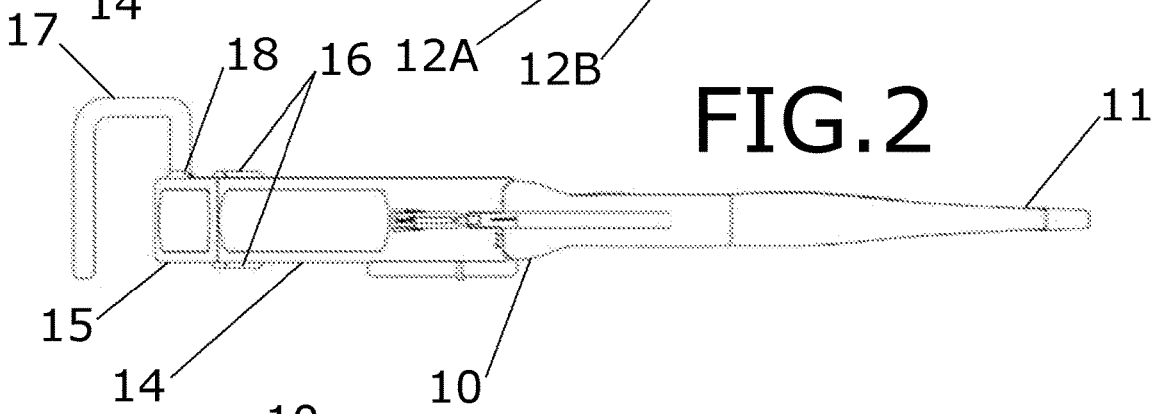
FIG.2
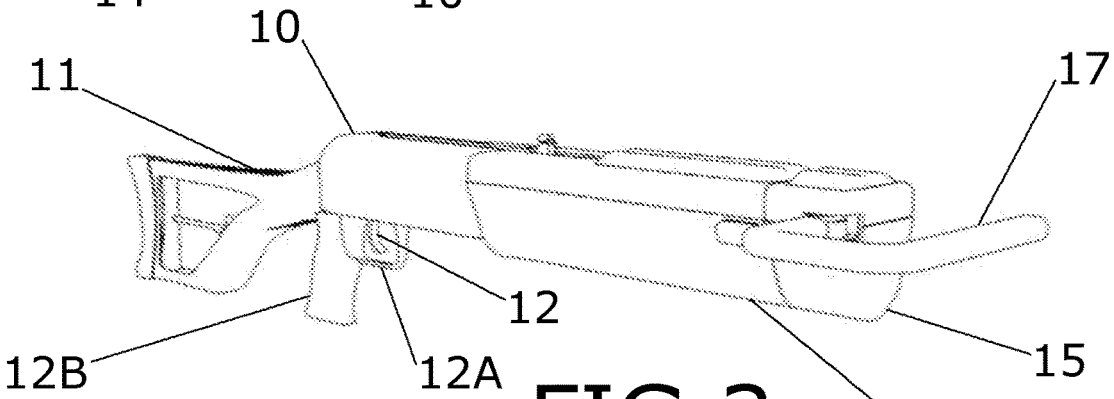
FIG.3
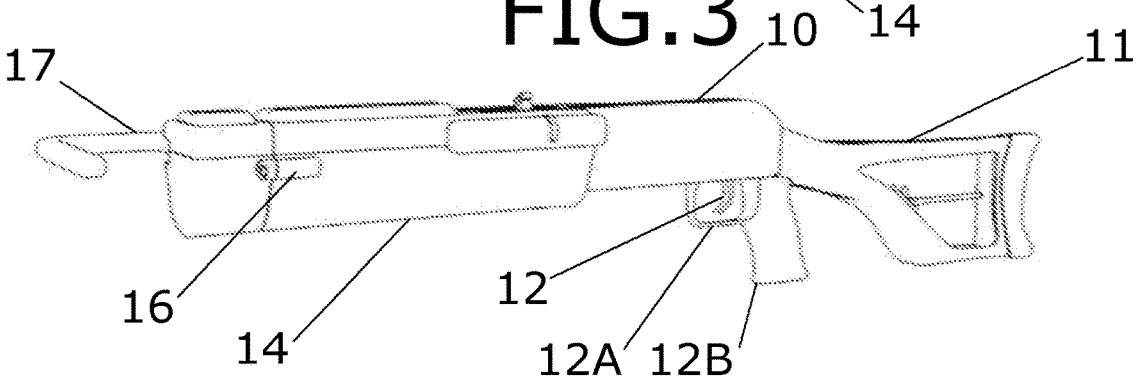

FIG.9
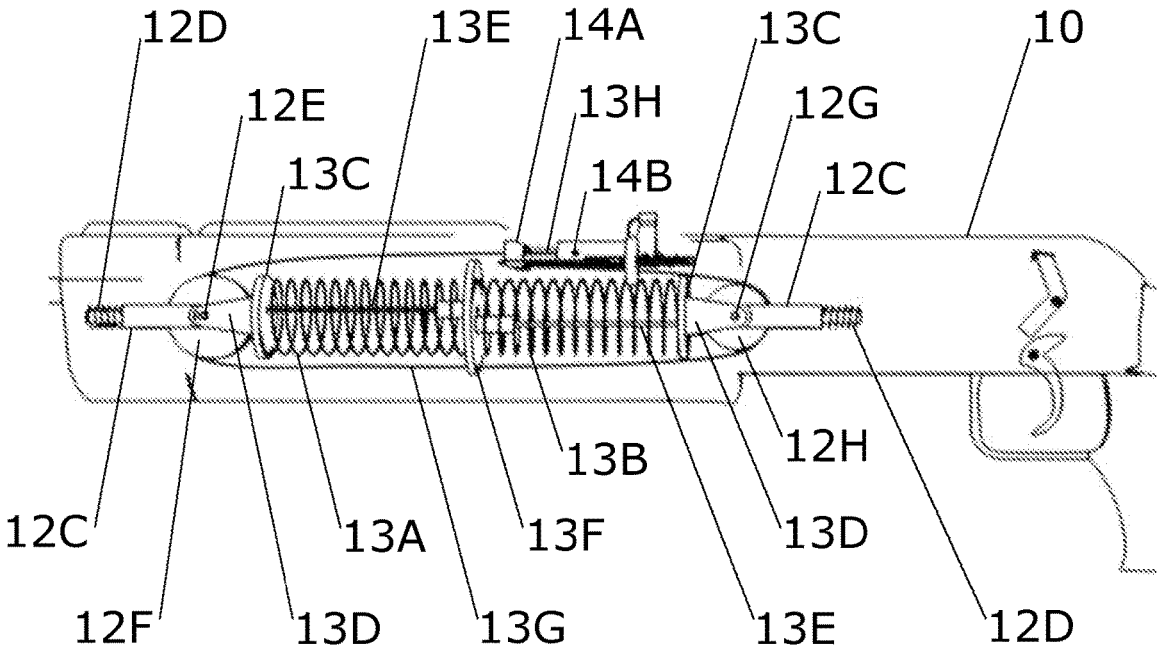
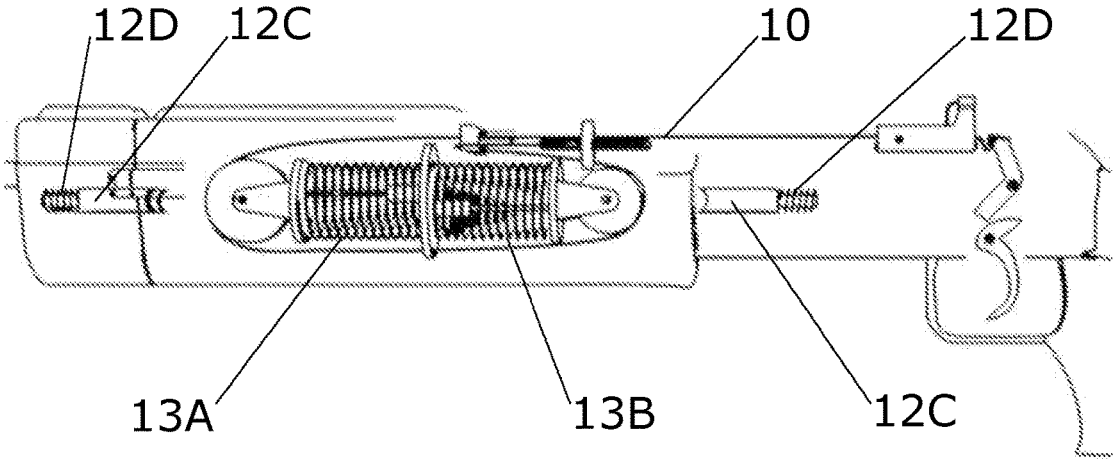
FIG.10

TENSION GUN FOR FIRING ARROWS

This application relates back to, and claims the priority of Provisional Patent Application No. 62/672,651 filed on May 17, 2018.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to bowhunting weapons and accessories, and in particular to a tension gun for firing arrows. Bowhunting with a conventional bow and arrows has remained fairly steady in popularity over the years, but hunters have seen a substantial increase in the popularity of more exotic weapons of this nature. In particular, the crossbow has gained a much larger number of shooters in the past 10 years. Unfortunately, the configuration of the bow arms creates an obstruction when the hunter is moving through brush or under low-hanging tree branches.

A search of the prior art reveals various devices which have been developed to address this set of problems, or related problems. None are closely related to the present invention, but several include features which resemble those of the present invention. Each has proven to be less than satisfactory for the present purpose in its own way.

Compressed gas-powered projectile accelerator, U.S. Patent Appl. No. 2004/0065310 (priority Mar. 6, 2002), provides a projectile accelerator having an improved means of gas distribution, a valve locking mechanism, an improved combined bumper/seal, and self-contained modular components to improve efficiency, manufacturability, and reduce size and weight.

Penetrating projectile system and apparatus, U.S. Pat. No. 4,123,975 (priority Mar. 3, 1976), provides a projectile having a length to diameter ratio greater than 6 to 1 which is propelled from a launcher by a propellant charge toward a rock target, at velocities of 500 ft./sec. and higher, to more efficiently penetrate the rock for excavation purposes.

Device for launching a projectile or a launch object in general, U.S. Patent Appl. No. 2011/0041820 (priority Mar. 10, 2008), provides a device for launching a projectile, comprising: a stock; at least two bending members associated to said stock on opposite sides thereof; tensioning means of said bending members, comprising at least two cams arranged on opposite sides of the stock, each of which is pivoted at a respective first axis of rotation and is associated to at least one corresponding bending member; pushing means of said projectile apt to cooperate with said bending members comprising at least two pushing arms arranged on opposite sides of the stock and connected to each other through a flexible pushing member wherein each of said pushing arms is pivoted at a respective axis of rotation and is apt to support a portion of said flexible pushing member, each of said pushing arms being operatively connected to a respective cam, wherein said device further comprises a flexible force member for commanding a rotation of a pushing arm, and two pairs of pulleys arranged on opposite sides of the stock, wherein each pair comprises a first pulley interposed between a respective pushing arm.

Projectile launcher, U.S. Pat. No. 5,671,722 (priority May 29, 1996), provides a projectile launching apparatus has a barrel for supporting a projectile for to and during launch. The barrel is defined by a breech end, a muzzle end and a longitudinal launch axis along which the projectile is launched. A length of elastomeric material is fixed at its ends to opposing sides of the barrel aft of the muzzle end. Linear actuators are aligned parallel to and on opposite sides of the barrel. A guide or pulley is mounted on each of the linear actuators for linear movement therewith to positions forward of the ends of the elastomeric material. Third and fourth guides or pulleys are fixed by a frame such that the fourth pulley is positioned aft of the third pulley along the longitudinal launch axis. The elastomeric material is led along a path from one fixed end, about the first pulley, between the third and fourth pulleys, and about the second pulley to where the elastomeric material terminates at its other fixed end. When the frame is drawn toward the breech end of the apparatus, the third pulley and the fourth pulley are simultaneously drawn towards the breech end to stretch the elastomeric material. The stretched elastomeric material creates the potential for accelerating the projectile towards the muzzle end for a projectile placed forward of the third pulley.

Elastic type projectile projecting device, U.S. Pat. No. 3,517,657 (priority May 20, 1968), provides an apparatus for firing conventional arrows, including a firing head with a rigid rod attached to one side of the firing head and a support stub projecting from the free end of the rigid rod. The firing head is an open member to which elastic firing means are fastened. Attached to the opposite side of the firing head from the rigid rod is an arrow guide. An arrow to be fired is placed through the firing head and supported by the arrow guide. The notch in the arrow receives the elastic firing means which are stretched to hold the arrow in a cocked position. The elastic firing means are held stretched by a person who is firing the arrow holding the elastic firing means in one hand and bracing that hand against the support stub. The other arm of the person is extended and grips the firing head to aim the arrow. The arrow is fired when the hand that holds the elastic firing means and the arrow therewith adjacent the firing stub releases the elastic firing means. Also disclosed is apparatus that can be attached to weapons such as longbows, slingshots and other catapulting devices, to enable those devices to be fired by a person using an extended arm to aim the projectile, the extended arm applying no force to the device to hold it in a cocked position. Simultaneously, while the extended arm aims the weapon the hand of other arm of the person firing the weapon is holding the weapon in a cocked position.

A weapon which can fire an arrow or similar projectile, providing a hunting experience similar to using a crossbow without the obstructive bow arms, enabling the user to move rapidly through such terrain obstacles, would be very useful and would be well-received. A tension gun for firing arrows, which employs an internal series of springs and a pulley-mounted cable to propel the arrow, would resolve this problem.

SUMMARY OF THE INVENTION

Accordingly, the invention is directed to a tension gun for firing arrows. The tension gun is comprised of a stock, a trigger, a pistol grip, and a forearm which are configured in a manner which is similar to a conventional crossbow. The bow arms are removed from the design, and replaced by a pair of coaxial coil springs and other tension multipliers within the forearm, which propel the arrow. A folding handle at the forward end of the forearm is provided for carrying the tension gun.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 is a side view of the first exemplary embodiment, displaying the tension gun 10, the stock 11, the trigger 12, the trigger guard 12A, the pistol grip 12B, the forearm 14, the endcap 15, a bolt 16, and the handle 17.

FIG. 2 is a top view of the first exemplary embodiment, displaying the tension gun 10, the stock 11, the forearm 14, the endcap 15, the bolts 16, the handle 17, and the hinge 18.

FIG. 3 provides two side perspective views of the first exemplary embodiment, displaying the tension gun 10, the stock 11, the trigger 12, the trigger guard 12A, the pistol grip 12B, the forearm 14, the endcap 15, a bolt 16, and the handle 17.

FIG. 9 is a close-up side transparency view of the central portion of the first exemplary embodiment with the coaxial spring segments extended, displaying the tension gun 10, the extension damper shafts 12C, the extension damper springs 12D, the forward twist control pin 12E, the forward control pulley 12F, the rear twist control pin 12G, the rear control pulley 12H, the forward coaxial spring segment 13A, the rear coaxial spring segment 13B, the spring caps 13C, the pulley yokes 13D, the alignment rods 13E, the center spring base 13F, the cable 13G, the catapult brake spring 13H, the shuttle 14A, and the guide rail 14B.

FIG. 10 is a close-up side transparency view of the central portion of the first exemplary embodiment with the coaxial spring segments compressed, displaying the tension gun 10, the trigger 12, the trigger guard 12A, the forward coaxial spring segment 13A, and the rear coaxial spring segment 13B.

DETAILED DESCRIPTION OF THE INVENTION

Figure 4:
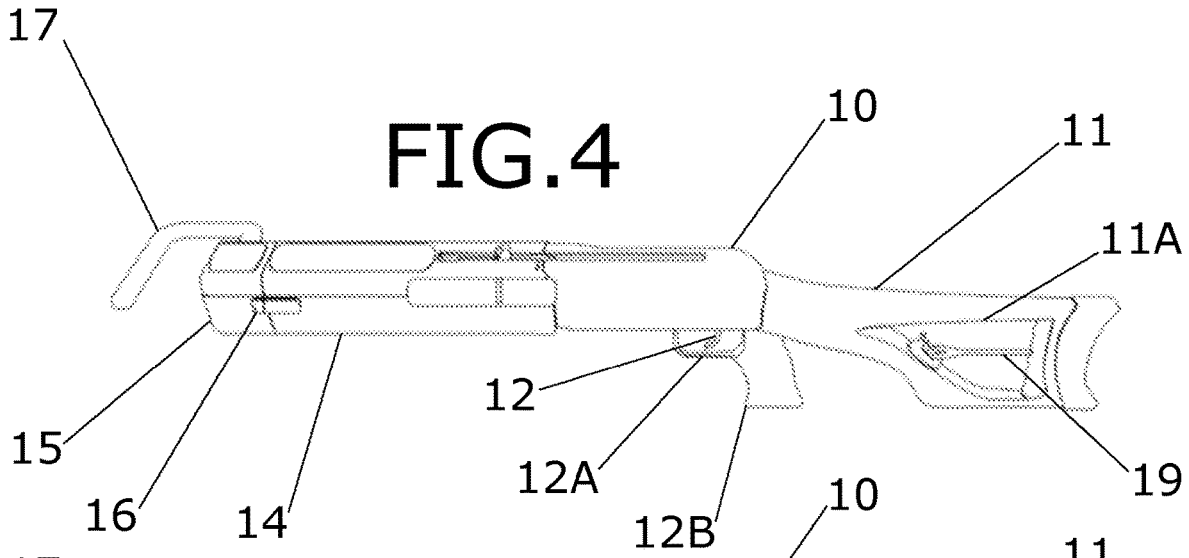
FIG. 4 is a top perspective view of the first exemplary embodiment with the handle unfolded, displaying the tension gun 10, the stock 11, the stock aperture 11A, the trigger 12, the trigger guard 12A, the pistol grip 12B, the forearm 14, the endcap 15, a bolt 16, the handle 17, and the loading tool 19.
Figure 5:
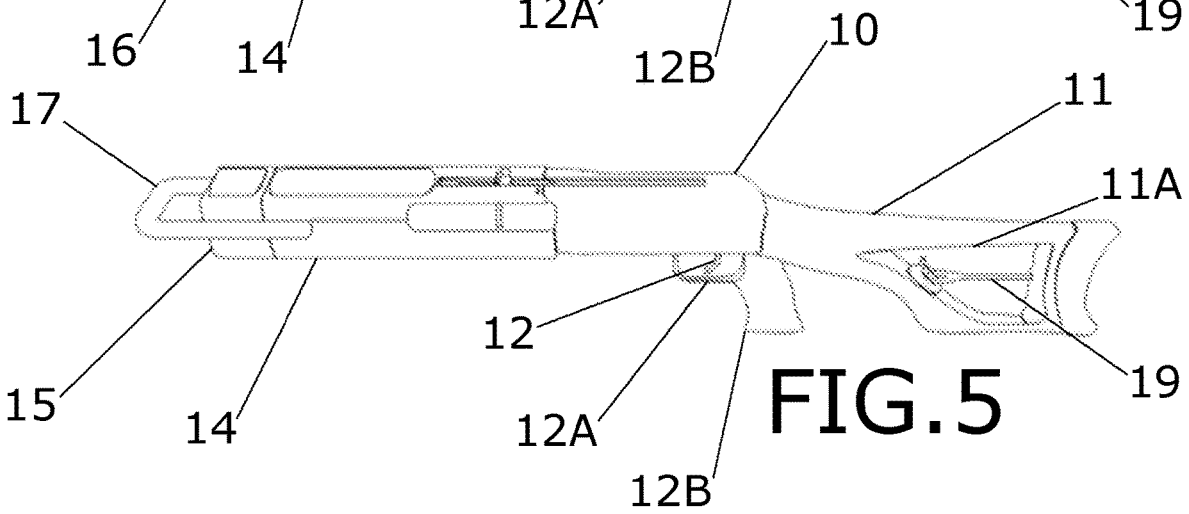
FIG. 5 is a top perspective view of the first exemplary embodiment, displaying the tension gun 10, the stock 11, the stock aperture 11A, the trigger 12, the trigger guard 12A, the pistol grip 12B, the forearm 14, the endcap 15, a bolt 16, the handle 17, and the loading tool 19.
Figure 6:
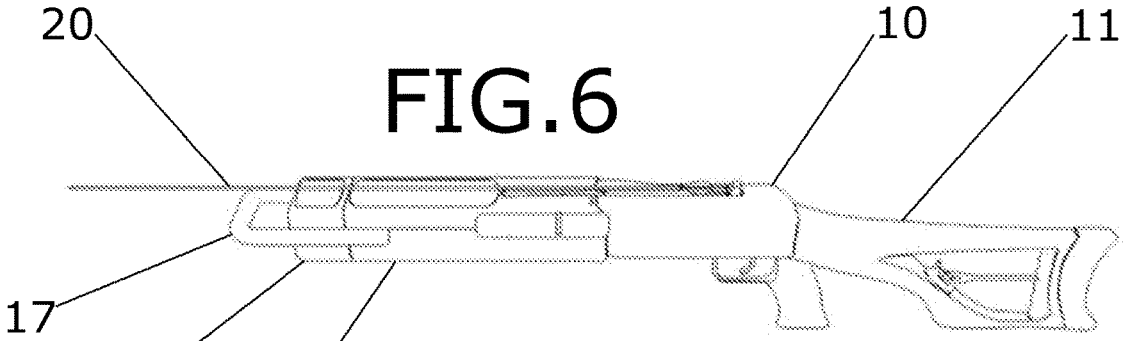
FIG. 6 is a top perspective view of the first exemplary embodiment with an arrow nocked, displaying the tension gun 10, the stock 11, the forearm 14, the endcap 15, the handle 17, and the arrow 20.
Figure 7:
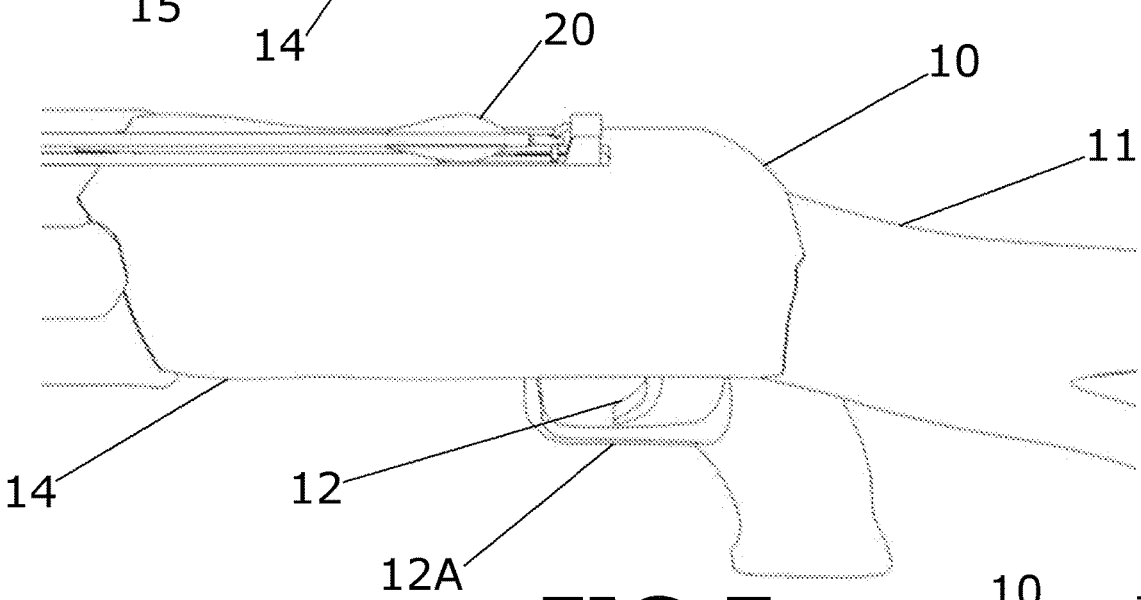
FIG. 7 is a close-up top perspective view of the central portion of the first exemplary embodiment with an arrow nocked, displaying the tension gun 10, the stock 11, the trigger 12, the trigger guard 12A, the forearm 14, and the arrow 20.
Figure 8:
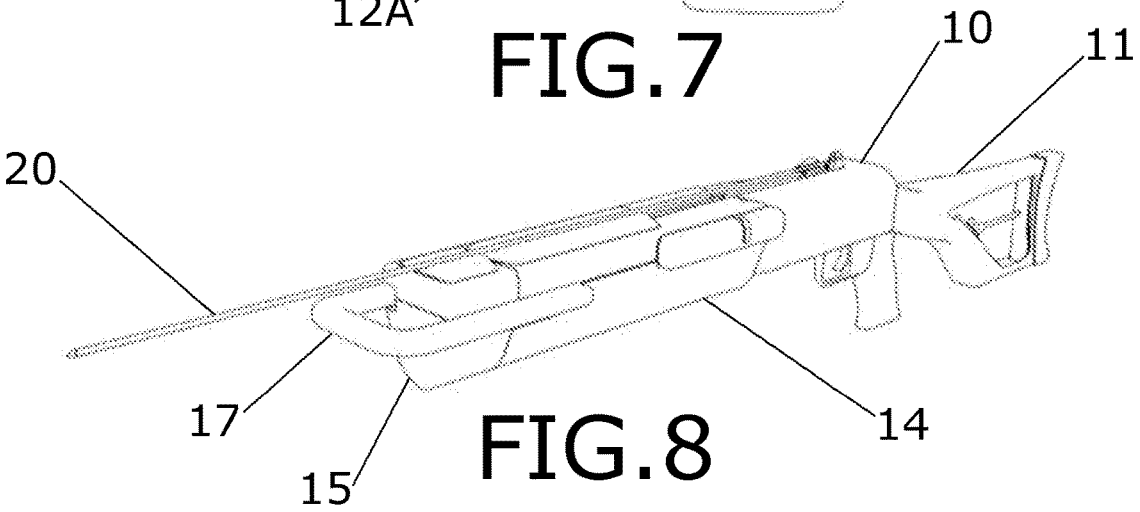
FIG. 8 is a front perspective view of the first exemplary embodiment with an arrow nocked, displaying the tension gun 10, the stock 11, the forearm 14, the endcap 15, the handle 17, and the arrow 20.
Figure 11:
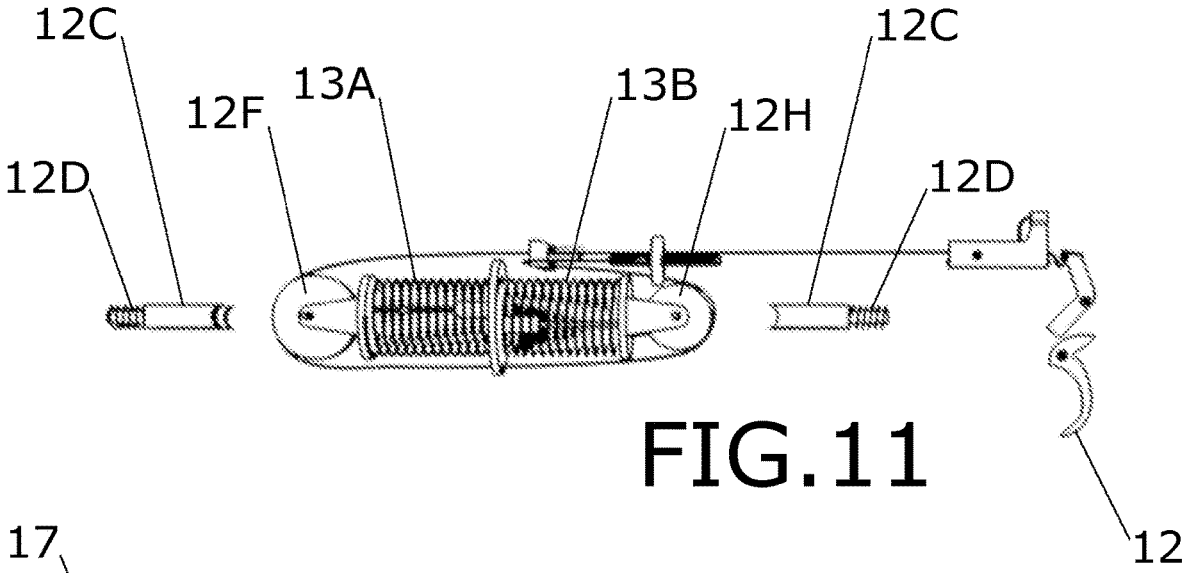
FIG. 11 is a side view of the spring, pulley, cable, and shuttle components of the first exemplary embodiment, displaying the trigger 12, the extension damper shafts 12C, the extension damper springs 12D, the forward control pulley 12F, the rear control pulley 12H, the forward coaxial spring segment 13A, the rear coaxial spring segment 13B, and the cable 13G.
Figure 12:
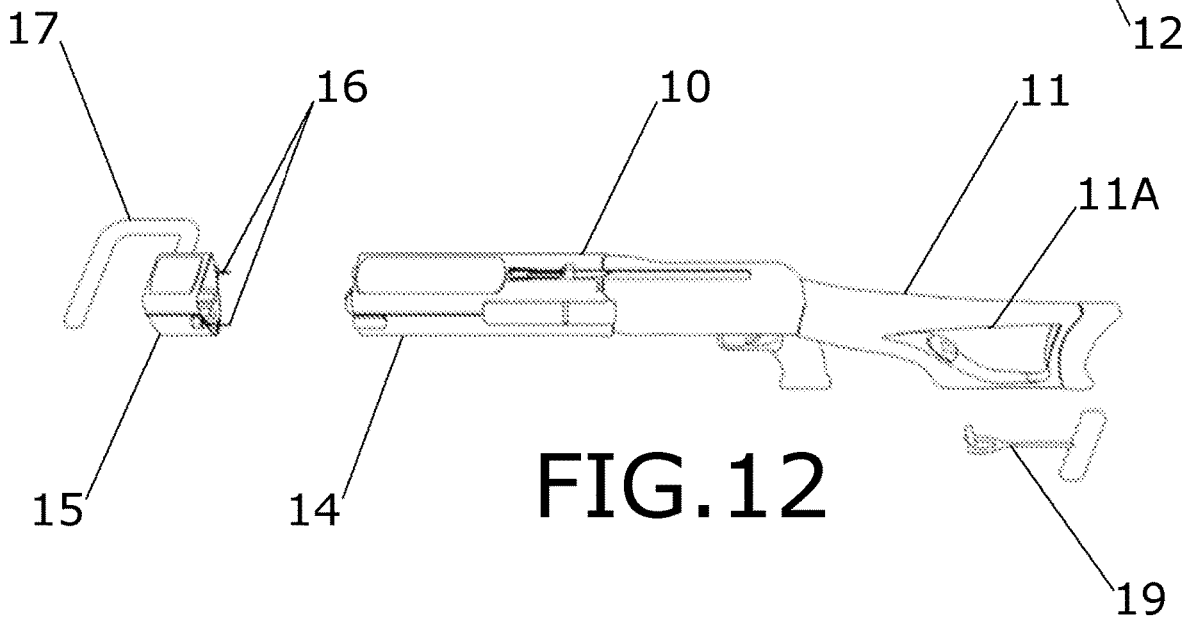
FIG. 12 is a top perspective view of the first exemplary embodiment with the endcap and loading tool removed, displaying the tension gun 10, the stock 11, the stock aperture 11A, the forearm 14, the endcap 15, the bolts 16, the handle 17, and the loading tool 19.

Referring now to the invention in more detail, the invention is a tension gun 10 for firing arrows 20.

The first exemplary embodiment is comprised of a stock 11, a trigger 12 with a trigger guard 12A, a pistol grip 12B, and a forearm 14 which are configured in a manner which is similar to a conventional crossbow. The bow arms are removed from the design, and replaced by a pair of coaxial coil spring segments and other tension multipliers within the forearm 14, which propel the arrow 20. The forward end of the forearm 14 is covered by a removable endcap 15, which is secured by two or more large bolts 16. The bolts 16 may be easily loosened with a standard or Phillips screwdriver.

The interior of the forearm 14 provides a forward coaxial spring segment 13A and a rear coaxial spring segment 13B, separated by a center spring base 13F. Each of the coil spring segments is kept in alignment by an axially positioned alignment rod 13E and a spring cap 13C. Each spring cap 13C is affixed to a pulley yoke 13D. The pulley yoke 13D on the forward coaxial spring segment 13A is secured to a forward control pulley 12F by a forward twist control pin 12E. The pulley yoke 13D on the rear coaxial spring segment 13B is secured to a rear control pulley 12H by a rear twist control pin 12G.

Preferably, the forward control pulley 12F is 2 inches in diameter, and the rear control pulley 12H is 1.5 inches in diameter. When the tension gun 10 is fired, each coil spring segment urges a pulley yoke 13D in an outward direction from the center spring base 13F. This motion of the pulley yoke 13D is stopped by an extension damper shaft 12C and an extension damper spring 12D. A stationary end of a cable 13G is fastened to an adjustment mechanism and the length of the cable 13G passes through the forward twist control pin 12E and the rear twist control pin 12G, terminating in a shuttle 14A mounted in a guide rail 14B. The cable 13G and the alignment rods 13E keep the coaxial coil spring segments in alignment.

A folding handle 16 at the forward end of the forearm 14 is provided for carrying the tension gun 10. The handle 16 is mounted on a hinge 17, which may be locked in either one of two positions: a carrying position, wherein the handle 16 is extended for the purpose of carrying the tension gun 10, and a firing position, wherein the handle 16 is folded for the purpose of firing the tension gun 10.

The stock 11 provides a large, triangular stock aperture 11A. A loading tool 19 is provided, which may be stored in the aperture 11A when not in use.

To use the first exemplary embodiment, the user may load an arrow 20 into the tension gun 10 with the loading tool 19, which may be used to compress the coaxial coil spring segments. The user may then aim the tension gun 10 at a target and squeeze the trigger 12, which fires the tension gun 10.

The stock 11, the pistol grip 12B, and the forearm 14 are preferably manufactured from rigid, durable materials such as billet aluminum, cast aluminum, or synthetic composite material. The trigger 12, the trigger guard 12A, the extension damper shafts 12C, the forward twist control pin 12E, the forward control pulley 12F, the rear twist control pin 12G, the rear control pulley 12H, the spring caps 13C, the pulley yokes 13D, the alignment rods 13E, the center spring base 13F, the shuttle 14A, and the shuttle track pin 14B are preferably manufactured from rigid, durable materials with substantial structural strength, such as steel and aluminum alloy.

The extension damper springs 12D, the forward coaxial spring segment 13A, the rear coaxial spring segment 13B, and the catapult brake spring 13H are preferably manufactured from a semi-rigid, durable material which provides an elastic quality, such as spring steel. The cable 13G is preferably manufactured from coated steel cable or synthetic cord such as Vectran™, Dacron™, or similar material as tension requirements dictate. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A tension gun for firing arrows, comprising:

stock, a trigger with a trigger guard, a pistol grip, and a forearm within which includes a forward coaxial spring segment and a rear coaxial spring segment that are separated by a center spring base, wherein the forward and rear coaxial spring segments are kept in alignment using respective axially positioned alignment rods, and wherein at least the forward and rear coaxial spring segments within the forearm are adapted to propel an arrow placed within the tension gun.

2. The tension gun of claim 1, wherein a forward end of the forearm is covered by a removable endcap, which is secured by two or more large bolts.

3. The tension gun of claim 1, further comprising a spring cap attached to each alignment rod and wherein each spring cap is affixed to a pulley yoke.

4. The tension gun of claim 3, wherein a forward pulley yoke on the forward coaxial spring segment is secured to a forward control pulley by a forward twist control pin, and a rear pulley yoke on the rear coaxial spring segment is secured to a rear control pulley by a rear twist control pin.

5. The tension gun of claim 4, wherein a stationary end of a cable is fastened to an adjustment mechanism and a length of the cable passes through the forward control pulley and the rear control pulley, terminating in a shuttle mounted in a guide rail.

6. The tension gun of claim 5, wherein the cable and the alignment rods keep the forward and rear coaxial spring segments in alignment.

7. The tension gun of claim 5, wherein a folding handle at a forward end of the forearm is provided for carrying the tension gun, mounted on a hinge, which locks in either one of two positions:

a carrying position, wherein the folding handle is extended to enable carrying the tension gun, and a firing position, wherein the folding handle is folded for of firing the tension gun.

8. The tension gun of claim 5, wherein squeezing the trigger causes the tension gun to fire.

9. The tension gun of claim 1, wherein when the tension gun is fired, each of the forward and rear coaxial spring segments urge respective pulley yokes in an outward direction from the center spring base, such that the motion of the pulley yokes is stopped by respective extension damper shafts and extension damper springs.

10. The tension gun of claim 1, wherein the stock provides a stock aperture and a loading tool which may be used to compress the forward and rear coaxial coil spring segments, and is configured for storage in the stock aperture when not in use.

* * * * *